US005729865A

United States Patent [19]

Stoddart

[11] Patent Number: 5,729,865

[45] Date of Patent: Mar. 24, 1998

[54] LOCK FOR TELESCOPING EXTENSION POLES

[75] Inventor: Kenneth R. Stoddart, Fond du Lac, Wis.

[73] Assignee: Bestt Rollr, Inc., Fond du Lac, Wis.

[21] Appl. No.: 611,724

[22] Filed: Mar. 7, 1996

[51] Int. Cl.[6] ..... A47B 95/02; B25G 1/04

[52] U.S. Cl. ..... 16/115

[58] Field of Search ..... 16/115; 15/144.3, 15/144.4

[56] References Cited

U.S. PATENT DOCUMENTS

| | | | |
|---|---|---|---|
| 2,610,875 | 9/1952 | Wheelden | 287/58 |
| 3,049,367 | 8/1962 | Lashta | 285/7 |
| 3,306,639 | 2/1967 | Lyon | 287/58 |
| 3,669,463 | 6/1972 | Boudreau | 280/47.37 |
| 3,866,257 | 2/1975 | Cansdale | 15/230.11 |
| 4,409,866 | 10/1983 | Mcbridge | 16/115 |
| 4,456,285 | 6/1984 | Weber-Henning | 280/823 |
| 4,687,076 | 8/1987 | Tu | 182/178 |
| 5,220,707 | 6/1993 | Newman et al. | 16/115 |
| 5,339,916 | 8/1994 | Louis | 180/19.3 |
| 5,579,558 | 12/1996 | Newman et al. | 16/115 |

*Primary Examiner*—Chuck Mah
*Assistant Examiner*—Mark Williams
*Attorney, Agent, or Firm*—Foley & Lardner

[57] ABSTRACT

A telescoping extension pole assembly includes an outer tube, an inner tube slidably received in the outer tube, and a locking mechanism having a slide button which is slidable parallel to the longitudinal axes of the inner and outer tubes. The locking mechanism further includes a resilient device which biases the slide button to a released position and a locking pin to a locked position for retaining the tubes in their adjusted position.

7 Claims, 4 Drawing Sheets

LOCK FOR TELESCOPING EXTENSION POLES

BACKGROUND OF THE INVENTION

1. Field of the Invention

The present invention relates to telescoping extension poles, and, more particularly, to a locking mechanism for telescoping extension poles wherein the locking mechanism utilizes a sliding button to selectively engage or disengage a locking pin. The invention is particularly suitable for use with telescoping extension poles for safely and reliably increasing the adjustable height of paint rollers.

2. Related Art

Telescoping extension poles are well known in the art. In a typical device, an outer tube holds an inner tube which can be extended to a desired length and locked into place. Such devices are useful, for example, as tool extenders to extend the reach of a user for the application of a tool such as a paint roller.

A locking method for a typical telescoping extension pole includes providing holes in the inner and/or outer tube such that a pin can selectively engage the holes, thereby locking the position of the tubes relative to each other. In such an arrangement a user must apply a force to the pin in a direction perpendicular to the longitudinal axes of the extension poles by pushing or pulling the pin. For example, if the inner tube has holes and the pin is spring mounted to the outer pole, the user must pull the pin out to clear the inner pole to allow the inner pole to slide. Alternatively, if the outer pole has holes and the inner pole has a spring mounted pin, the user must push the pin in to clear the outer pole to allow the inner pole to slide.

U.S. Pat. No. 5,220,707 issued to Newman, Sr. et al. discloses a locking assembly including a push button which enables the user to pull the pin out by pushing the button in. Similar to the prior art noted above, the user must push the button in a direction perpendicular to the longitudinal axes of the extension poles.

SUMMARY OF THE INVENTION

The present invention comprises a telescoping extension pole assembly utilizing a locking mechanism having a slide button moveable longitudinally of the extension poles. This greatly facilitates operation of the lock.

More particularly, the invention comprises a telescoping extension pole assembly comprised of inner and outer tubes, wherein the inner tube has a number of spaced openings in its outside surface. A locking mechanism with a housing fits securely over the outer tube and has an opening to receive the inner tube. Inside the housing, a locking pin is provided which fits in the openings in the inner tube such that the inner tube cannot slide when the locking pin is in one of the openings. The housing also holds a slide button which can be accessed from outside the housing and slid parallel to the longitudinal axis of the extension pole assembly from a released position to an actuated position. The locking pin is resiliently mounted such that the locking pin is moved to disengage an opening when the slide button is slid to its actuated position, with release of the slide button effecting simultaneous engagement of the locking pin in an aligned opening and return of the slide button to its released position.

DETAILED DESCRIPTION OF THE PREFERRED EMBODIMENTS

Figure 1:
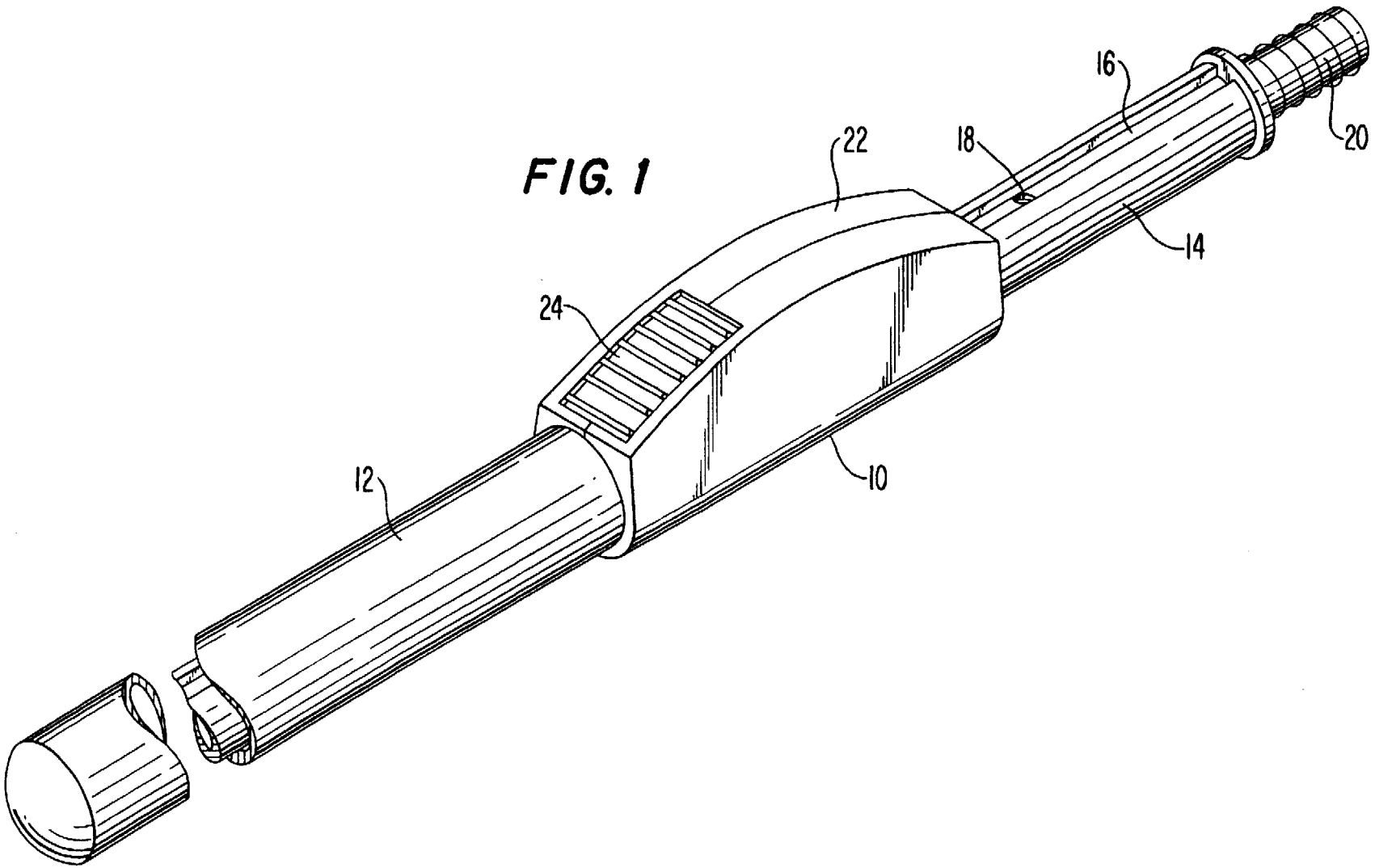
FIG. 1 is a perspective view of one embodiment of the telescoping extension pole assembly according to the present invention.

FIG. 1 shows the preferred embodiment of the present invention with a locking mechanism 10 extending around and being secured to the outer tube 12. An inner tube 14 is telescopically received within the outer tube, and is formed with a longitudinal channel 16 having a plurality of openings 18, only one of which is shown in FIG. 1. The inner tube 14 is formed at its leading end with an adapter such as threaded section 20 adapted to threadedly receive a paint roller or threaded devices or tools (not shown).

Locking mechanism 10 has a housing 22 and a button 24. As clearly shown in FIGS. 2A and 2B, button 24 slides parallel to the longitudinal axes of inner and outer tubes 14 and 12. When button 24 is slid to an actuated position, shown in FIG. 2B, locking mechanism 10 operates to clear the opening 18, as will be hereinafter described, thereby allowing inner tube 14 to freely slide in and out of outer tube 12. When button 24 is released, it returns to its FIG. 2A position when aligned with the opening 18, thereby locking the inner tube 14 in its adjusted position.

Figure 2A:
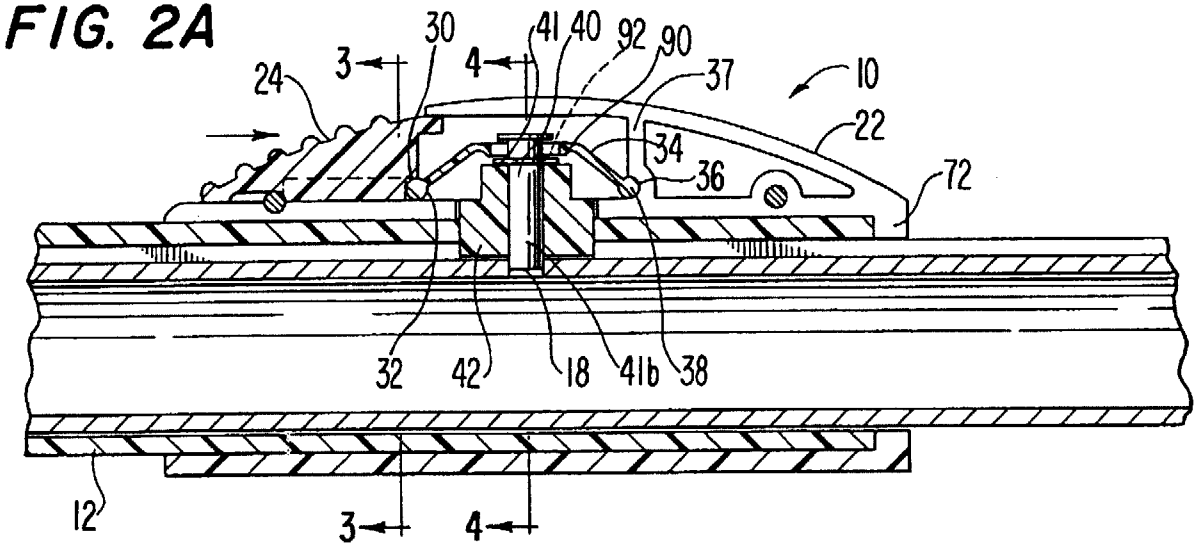
FIG. 2A is a fragmentary side sectional view of the telescoping extension pole assembly according to the present invention, showing the locking mechanism in a locked position.
Figure 2B:
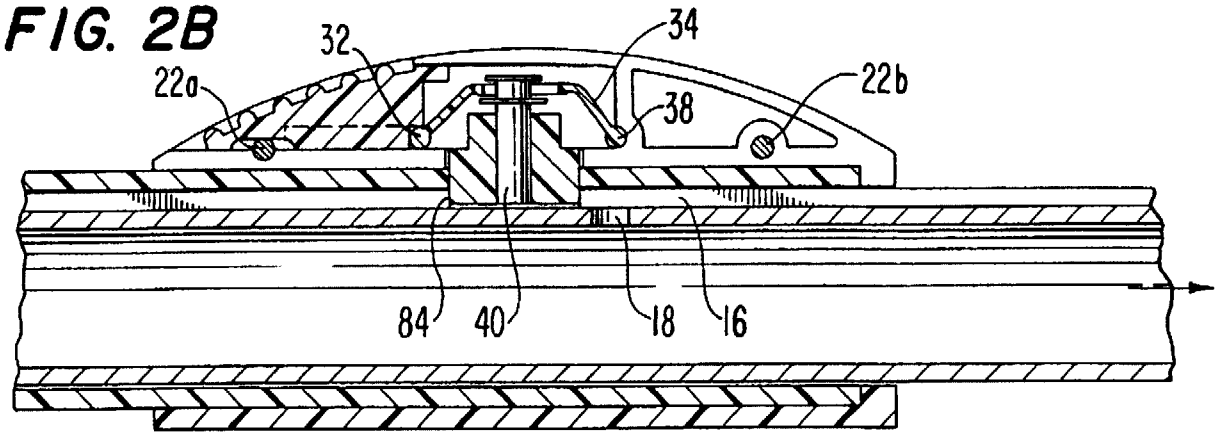
FIG. 2B is a fragmentary side sectional view similar to FIG. 2A, but showing the locking mechanism in an unlocked position.

Referring to FIGS. 2A and 2B, button 24 is formed with an indent 30 into which extends a spherical end 32 of a resiliently collectable spring 34. A similar curved indent 36 is oppositely formed in rib 37 of housing 22, with the opposite spherical end 38 of the spring 34 engaging the indent 36.

A locking pin 40 is secured to the central, uppermost portion of the spring 34 by spring clip 41. The lower end of the pin 40 extends through a sleeve 42 having a central opening to loosely receive the pin. The pin 40 is vertically moveable relative to the sleeve from a locking position shown in FIG. 2A in which the pin extends into the opening 18, to a withdrawn position shown in FIG. 2B in which the inner tube 14 can be adjusted relative to the outer tube 12. Although only one spaced opening 18 has been shown in FIGS. 2A and 2B, it will be understood that numerous longitudinally spaced openings are provided to accommodate a large number of adjustment positions of the inner tube 12.

It will thus be seen that when the ends 32 and 38 of the spring 34 are deflected towards each other, the top portion of the spring 34 is raised, thereby raising pin 40 to a withdrawn position. The spring 34 has a resiliency which imparts a restoring force to ends 32 and 38 such that when ends 32 and 38 are not deflected (or when the deflecting force is insufficient to overcome the restoring force), the ends 32 and 38 return to their at rest positions.

In FIG. 2A, button 24 is in a released position and locking pin 40 is engaged in opening 18, thereby preventing inner tube 14 from sliding. When the button is actuated, by being slid to the right relative to the housing 22 as shown in FIG. 2B, the end 32 of the spring 34 is moved toward the fixed end 38 of the spring, thereby deflecting the spring and lifting the pin 40 from the opening 18 in the inner tube 14.

Figure 3:
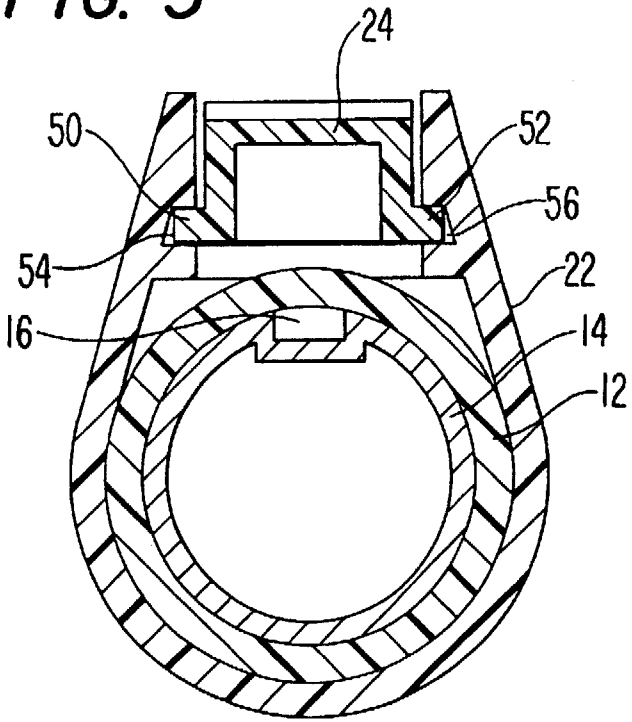
FIG. 3 is a sectional view taken along line 3—3 of FIG. 2A.

Referring to FIG. 3, button 24 has bottom outwardly extending flanges 50 and 52 which fit in slots 54 and 56 of housing 22. Slots 54 and 56 operate to constrain button 24 to slide along a desired path, and may have front and/or back stops which delimit the range of movement for button 24.

Figure 4:
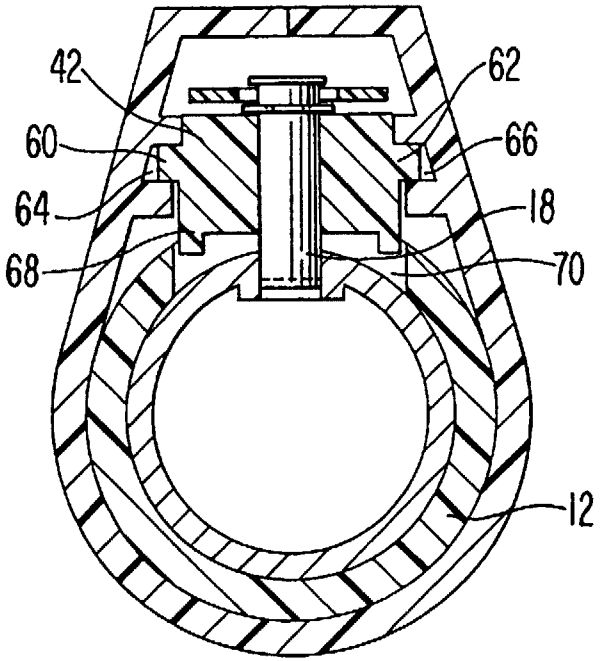
FIG. 4 is a sectional view taken along line 4—4 of FIG. 2A.

As shown in FIG. 4, sleeve 42 is formed with laterally extending flanges 60 and 62 which are press fit in slots 64 and 66 formed in housing 22, whereby the position of sleeve 42 is fixed in the housing 22 and the sleeve 42 does not slide or otherwise move relative to the housing 22. The bottom of the sleeve 42 is formed with flanges 68 which extend into an opening 70 formed in the outer tube 12 (FIG. 4) thereby serving to position the sleeve 42, and thus the pin 40, in a vertical plane perpendicular to the longitudinal axes of the inner and outer tubes.

The housing 22 is formed with an annular inwardly directed flange 72 (FIG. 2A) at its leading end which extends over the front edge of the outer tube 12. The flange 72 and the sleeve 42 position the locking mechanism, front to rear, on the outer tube 12. The housing 22 is split down the center and can be spread apart for insertion of the various internal parts including the sleeve 42. Screws **22*a* and 22*b* (FIG. 2B) hold the housing 22** closed.

Figure 5:
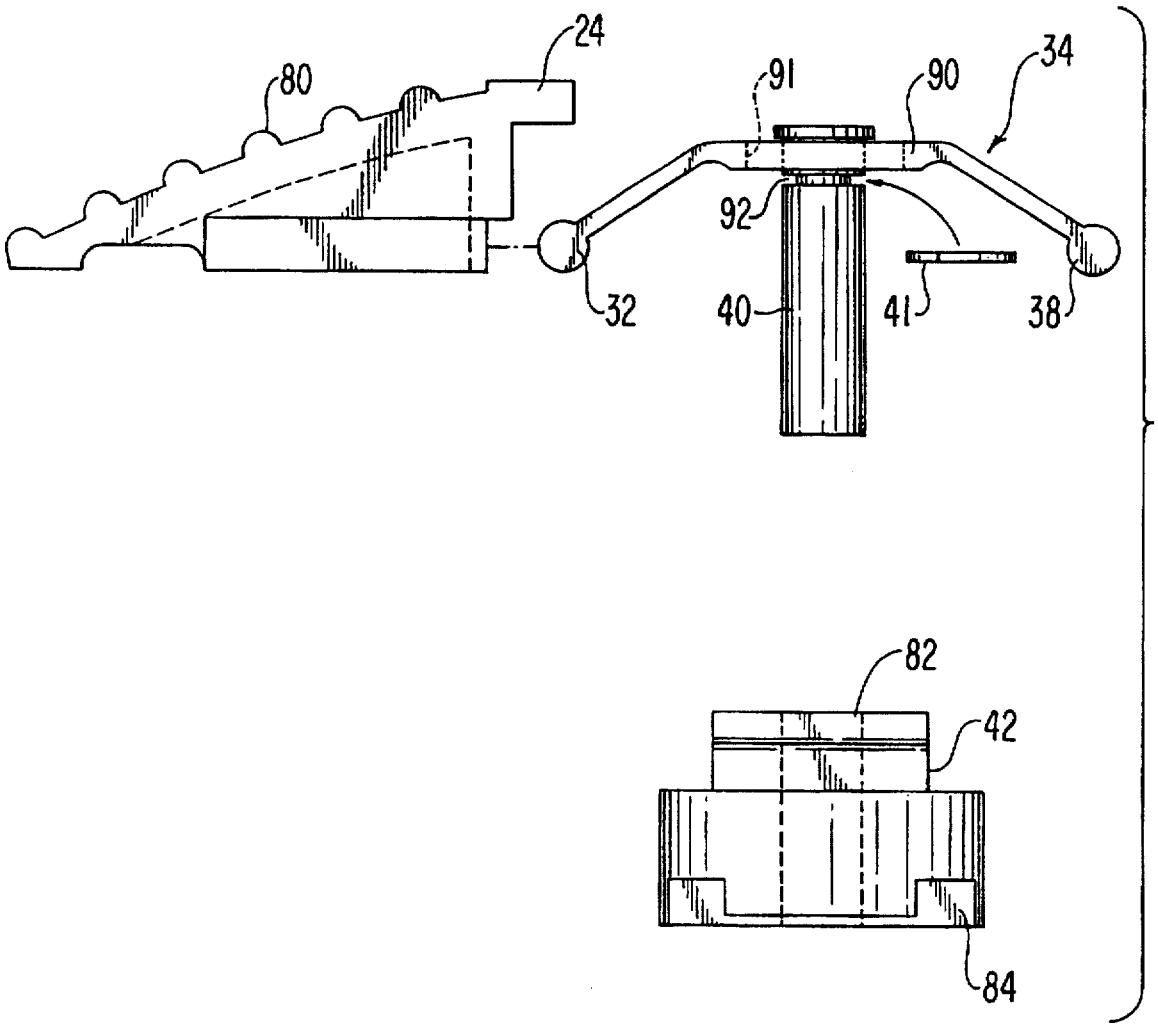
FIG. 5 is an exploded view of a portion of the locking mechanism according to the present invention.

FIG. 5 shows an exploded view of various parts of the locking mechanism 10, many previously described and referred to by the same reference numbers. Button 24 is formed with ribs 80 which aid the user in maintaining contact with the button 24 when applying a sliding force to the button 24. Sleeve 42 further includes a keying tab 84 which extends past opening 70 and into channel 16 (FIGS. 2A and 2B), thereby limiting rotation of inner tube 14 during sliding and assisting alignment of locking pin 40 with opening 18.

Still referring to FIG. 5, the enlarged head of pin 40 engages the surface of the top center portion 90 of the spring around a narrow elongated slot 91, through which the body of the pin passes. The pin is formed with an annular groove 92 adapted to receive the spring clip 41 to retain the pin on the spring 34. The clip 41 is conventional and forms no part of the present invention. The spring clip is shown separate in the exploded view comprising FIG. 5, but in an operative position in FIGS. 2A, 2B and 4.

A feature of the present invention is that, absent an actuating force, the spring 34 operates to simultaneously bias button 24 to its released position and consequently locking pin 40 to a biased position adapted to engage an opening 18. Even with button 24 in its released position, the spring 34 continues to apply a restoring force to locking pin 40 which biases locking pin 40 against channel 16 when an opening 18 is not aligned with the locking pin 40. The restoring force further operates to push locking pin 40 into opening 18 when they become aligned during adjustment of the inner tube 14 relative to the outer tube 12.

To move button 24 to its actuated position, a force, for example, the thumb of the user, is applied to the button 24 to overcome the restoring force of the spring 34, thus deflecting the spring 34 as shown in FIG. 2B. This withdraws the pin from the opening 18. When button 24 is released, the restoring force of the spring 34 pushes button 24 back to its released position (FIG. 2A).

Various modifications may be made to the embodiment of the invention as described herein. For example, while outer tube 12 and inner tube 14 are shown as substantially round, one skilled in the art will appreciate that they could be any of a number of shapes and may even be different shapes with respect to each other. Outer tube 12 may be oval while inner tube 14 is rectangular. While opening 18 is shown as extending all the way through the thickness of the inner tube 14, a partially extending recess could be provided as well. Other methods could also be used to secure locking mechanism 10 to outer tube 12.

It will be understood that other modifications in the form of the invention described herein and its preferred embodiments may be made without departing from the spirit thereof and of the scope of the claims which follow.

What is claimed is:

1. An extension pole assembly comprising:

an outer tube having a longitudinal axis;

an inner tube telescopically receivable within said outer tube and slidable along said longitudinal axis, said inner tube having a plurality of openings in an exterior surface thereof;

a locking mechanism including:

a locking pin mounted transversely to said longitudinal axis and receivable within one of said openings in said inner tube depending on a longitudinally adjustable position of the inner tube relative to the outer tube, said locking pin when so received locking said inner tube in its adjusted position, a button mounted on the exterior of said outer tube for longitudinal sliding movement along a path parallel to the longitudinal axis of the outer tube, and a resiliently deflectable member positioned between and operatively directly connected to the button and the locking pin, the deflectable member when the button is released resiliently biasing the pin into an opening in the inner tube to lock the inner tube to the outer tube, and wherein the button when actuated by sliding longitudinal movement directly engaging and resiliently deflecting the deflectable member and raising the pin from locking engagement in the opening, thereby permitting the inner tube to be longitudinally adjusted relative to the outer tube.

2. An extension pole assembly according to claim 1, wherein the resiliently deflectable member comprises:

a top portion having a slot for mounting the locking pin, and opposed legs connected to the top portion, wherein said legs are biased to return to an original position if said legs are displaced from the original position.

3. An extension pole assembly comprising:

an outer tube having a longitudinal axis;

an inner tube telescopically receivable within the outer tube and slidable along the longitudinal axis, the inner tube having a plurality of openings in an exterior surface thereof;

a locking mechanism including:

a housing fitted over the outer tube and secured to the outer tube, said housing being formed with an opening to receive the outer and inner tubes;

a locking pin located within the housing and receivable within a selected opening of said inner tube for locking the inner tube relative to said outer tube when the locking pin engages the selected opening, the locking pin being mounted for movement transversely to the longitudinal axis;

a button mounted on the housing and accessible exteriorly of the housing, said button being mounted for sliding movement along a path parallel to the longitudinal axis, from a released position to an actuated position; and a resilient device operatively directly connected to and positioned between the button and the pin, the button when slid to an actuated position directly engaging the resilient device device and biasing the locking pin to disengage the pin from the selected opening, with the resilient device, when the button is released, biasing the pin to engage the selected or another one of the openings in the inner tube for locking the inner tube to the outer tube.

4. An extension pole assembly according to claim 3, wherein the locking mechanism further comprises:

a separate sleeve for receiving the locking pin and guiding the locking pin in its movement transverse to the longitudinal axis.

5. An extension pole assembly according to claim 3, wherein the housing further includes opposed horizontal slots, and the button is formed with laterally extending flanges movable in the slots so that the sliding movement of the button is horizontal and parallel to the longitudinal axis.

6. An extension pole assembly comprising:

an outer tube having a longitudinal axis;

an inner tube receivable within the outer tube and slidable along the longitudinal axis, an outer surface of the inner tube defining a channel in which are formed a plurality of longitudinally spaced openings;

a locking mechanism operatively connected to the outer tube for releasably locking the inner tube in a locked position, said locking mechanism including:

a housing formed with a first slot and a second slot;

a locking pin adapted to engage one of the spaced openings in the inner tube;

a sleeve having a flange engaging the first slot to secure the sleeve to the housing, the sleeve being formed with an opening adapted to receive the locking pin for guiding the looking pin along a direction transverse to the longitudinal axis;

a button having a flange means engaging the second slot, the button being constrained by the second slot to slide along a path parallel to the longitudinal axis; and a resilient member coupled to the locking pin and directly engaging the button, the button when actuated by sliding movement directly engaging and deflecting the resilient member to bias the locking pin outwardly through the sleeve and away from its engaged opening, thereby freeing the inner tube for longitudinal adjustment relative to the outer tube, with the resilient member, when the button is released, biasing the locking pin inwardly to engage an aligned opening in the inner tube for again locking the inner tube to the outer tube.

7. The assembly of claim 6, wherein the resilient device comprises a spring having a top portion formed with an opening to receive the locking pin, and opposed leg portions terminating in spherical end portions, one spherical end portion engaging an indent formed in the button and the other spherical end portion engaging a similar indent formed in the housing, whereby the spring securely operatively engages the button and the housing.

* * * * *